US007204574B2

(12) United States Patent
Bertelsen et al.

(10) Patent No.: US 7,204,574 B2
(45) Date of Patent: Apr. 17, 2007

(54) POLYIMIDE THICKFILM FLOW FEATURE PHOTORESIST AND METHOD OF APPLYING SAME

(75) Inventors: Craig M. Bertelsen, Union, KY (US); Sean T. Weaver, Union, KY (US)

(73) Assignee: Lexmark International, Inc., Lexington, KY (US)

( * ) Notice: Subject to any disclaimer, the term of this patent is extended or adjusted under 35 U.S.C. 154(b) by 287 days.

(21) Appl. No.: 10/881,806

(22) Filed: Jun. 30, 2004

(65) Prior Publication Data

US 2006/0001694 A1 Jan. 5, 2006

(51) Int. Cl.
*B41J 2/015* (2006.01)

(52) U.S. Cl. ..... 347/20; 347/63; 347/47

(58) Field of Classification Search ..... 347/20, 347/44, 47, 56, 61–63, 65, 67
See application file for complete search history.

(56) References Cited

U.S. PATENT DOCUMENTS

| | | | | |
|---|---|---|---|---|
| 4,130,600 | A | 12/1978 | Zahir et al. | 525/530 |
| 4,558,333 | A * | 12/1985 | Sugitani et al. | 347/65 |
| 4,626,474 | A | 12/1986 | Kim | 428/416 |
| 5,010,355 | A | 4/1991 | Hawkins et al. | 347/63 |
| 5,162,140 | A | 11/1992 | Taniguchi | 428/41.1 |
| 5,260,130 | A | 11/1993 | Sakaguchi et al. | 428/355 EP |
| 5,434,607 | A * | 7/1995 | Keefe | 347/47 |
| 5,457,149 | A | 10/1995 | Hall et al. | 525/523 |
| 5,510,425 | A | 4/1996 | Matsuura et al. | 525/423 |
| 5,534,901 | A | 7/1996 | Drake | 347/63 |
| 5,686,224 | A | 11/1997 | O'Neill | 347/65 |
| 5,859,155 | A | 1/1999 | Furihata et al. | 525/531 |
| 5,869,595 | A | 2/1999 | Fuller et al. | 347/56 |
| 5,907,333 | A | 5/1999 | Patil et al. | 347/20 |
| 6,054,509 | A | 4/2000 | Arai et al. | 523/428 |
| 6,151,042 | A | 11/2000 | Smith et al. | 347/20 |
| 6,214,460 | B1 | 4/2001 | Bluem et al. | 428/355 AC |
| 6,260,956 | B1 | 7/2001 | Narang et al. | 347/63 |
| 6,336,713 | B1 * | 1/2002 | Regan et al. | 347/62 |
| 6,409,316 | B1 | 6/2002 | Clark et al. | 347/63 |
| 6,485,130 | B2 | 11/2002 | DeLouise et al. | 347/63 |
| 6,518,362 | B1 | 2/2003 | Clough et al. | 525/109 |
| 6,540,334 | B1 | 4/2003 | Mrvos et al. | 347/63 |

* cited by examiner

*Primary Examiner*—Juanita D. Stephens
(74) *Attorney, Agent, or Firm*—Luedeka, Neely & Graham

(57) ABSTRACT

A polyimide photoresist for thick film flow features adheres to a polyimide nozzle plate or other materials, without the use of an adhesive material between the two surfaces. Further, the photoresist can utilize an acrylate UV initiator, which can reduce the potential for HF to interact with the ink, and which can cause flocculation and eliminate the need for extremely long postbake cures used to remove HF from the photoresist. In another embodiment, an epoxy adhesive containing a dicyandiamide catalyst can be used to improve adhesion between polyimide films and a respective substrate.

8 Claims, 2 Drawing Sheets

POLYIMIDE THICKFILM FLOW FEATURE PHOTORESIST AND METHOD OF APPLYING SAME

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Technical Field of the Invention

This invention relates to the field of inkjet printheads and printing apparatuses and, in a particular embodiment, to the production of printheads having a polyimide as a photoresist for the thick flow features which adheres to a nozzle plate of polyimide or other materials, without the use of an adhesive material between the two surfaces.

2. General Background of the Invention

In the art of inkjet printing, inkjet printheads utilize semiconductor chips which are electrically activated to eject ink droplets on demand through nozzle holes in a nozzle plate attached to the chips. The ink ejection devices are located in close proximity to the ink feed via or slot along opposing sides. In order for the inkjet nozzles to perform optimally, higher firing frequencies of the inkjet nozzles are needed, to produce higher print speed and better resolution. In order to obtain this goal, there is a need to implement flow features into the photoresist on the wafer, instead of in the adhesive used to bind the nozzle plate. This type of process is currently referred to as thickfilm flow features. The thickfilm flow feature photoresist must have a high enough glass transition temperature (Tg) to withstand all of the other heat processes, minimal hydrofluoric acid (HF) production, superior adhesion, and great durability in the presence of the ink.

In U.S. Pat. No. 6,540,334, assigned to Lexmark International, Inc., the thickfilm layer applied to the chip provides a surface for attachment of a nozzle plate to the upper surface of the chip. In the prior art, such as U.S. Pat. No. 6,540,334, the thickfilm layer is derived from a radiation and/or heat curable polymeric film preferably containing a difunctional epoxy material, a polyfunctional epoxy material, and suitable cure initiators and catalysts. The disclosure of U.S. Pat. No. 6,540,334 is incorporated herein by reference.

Using an epoxy material such as disclosed in U.S. Pat. No. 6,540,334 requires additional nozzle plate adhesives and increases the overall height of the nozzle plate stackup, which does not allow high firing frequencies.

The following U.S. Patents, and all patents mentioned herein, are incorporated herein by reference:

U.S. Pat. Nos.: 5,010,355; 5,534,901; 5,686,224; 5,869,595; 5,907,333; 6,151,042; 6,260,956; 6,409,316; 6,485,130; 6,540,334; 4,130,600; 4,626,474; 5,162,140; 5,260,130; 5,457,149; 5,510,425; 5,859,155; 6,054,509; 6,214,460; 6,518,362.

BRIEF SUMMARY OF THE INVENTION

In tests conducted at Lexmark International, Inc., it has been found that polyimide photoresists, such as the HD4000 from HD Microsystems, have shown great promise as a thickfilm photoresist.

In one embodiment, the present invention includes the use of a polyimide as a photoresist for the thick film flow features which adheres to a polyimide nozzle plate or nozzle plates of other materials, without the use of an adhesive material between the two surfaces. The photoresist can utilize an acrylate UV initiator, which can reduce the potential for hydrofluoric acid (HF) to interact with the ink and cause flocculation, and can also eliminate the need for extremely long postbake cures used to remove HF out of the photoresist. The polyimide photoresist can be used to bond directly to the nozzle plate material. In those embodiments where both the photoresist and the nozzle plate are polyimides, the photoresist can be imaged with flow features while still in the partially-uncured state (polyamic acid) and then bonded to the nozzle plate using a thermal compression bonding (TCB) process. During a thermal compression stage, the nozzle plate and photoresist are taken to an elevated temperature (typically about 302–752 degrees Fahrenheit) at which the polyamic acid of the photoresist is imidized forming a bond between the photoresist and the nozzle plate material. This can eliminate the need for additional nozzle plate adhesives, as is found in the prior art, and also decrease the overall height of the nozzle plate stackup, which can enable higher firing frequencies to be obtained.

Another embodiment of the present invention includes a method of adhering items to a polyimide-containing inkjet printhead using an epoxy-based adhesive using dicyandiamide as a catalyst to cause the epoxy to bond to the polyimide. Thus, if an adhesive is used to bond anything to a polyimide layer of the printhead, the adhesive is preferably an epoxy, and dicyandiamide is preferably used as a catalyst. The stack up could look like FIG. 3, with epoxy, for example, as the adhesive layer 20. The present inventors have found that adhering epoxy to polyimide using dicyandiamide as a catalyst can result in a bond superior to that of prior art bonds (other catalysts could include dicyandiamide derivatives, such as anhydride, cycracure, imidazoles, or ternary amines).

The novel ink jet printheads of the present invention can be used in various types of ink jet printers (such as Lexmark® Model Z51, Lexmark® Model Z31, and Lexmark® Model Z11, Lexmark® Photo Jetprinter 5770, or Kodak® PPM200).

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE EXEMPLARY EMBODIMENTS

FIGS. 1–5 illustrate exemplary embodiments of the present invention.

Figure 1:
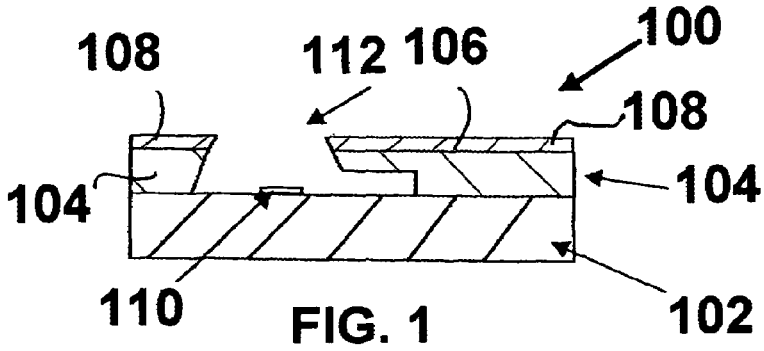
FIG. 1 is a partial cross-sectional view of a printhead with the polyimide thick film flow feature bonded to the nozzle plate material in the process of one embodiment of the present invention.
Figure 2:
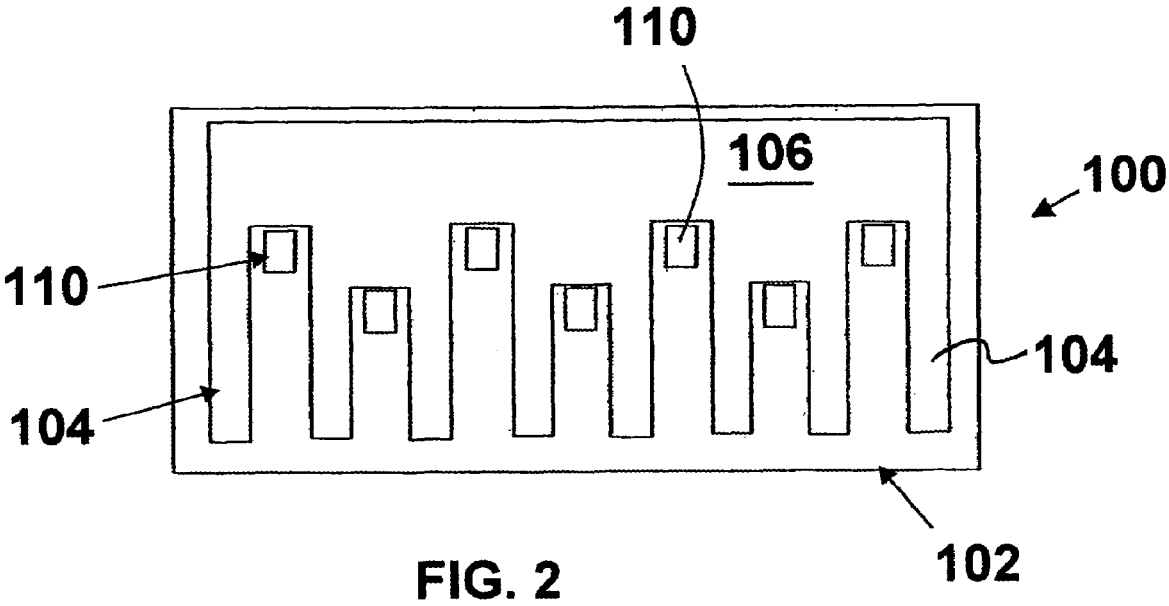
FIG. 2 is a top view of the polyimide thickfilm flow feature imaged pattern of an embodiment of the present invention.
Figure 3:
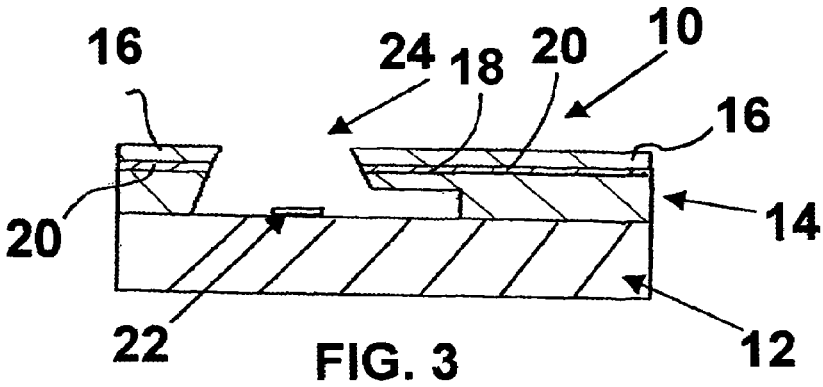
FIG. 3 is a partial cross-sectional view of a printhead with the thick film flow feature bonded to the nozzle plate material with a bonding adhesive therebetween, using dicyandiamide as a catalyst.

Before turning to FIG. 1 and 2, reference is made to the prior art chip in FIG. 3. FIG. 3 is a view of a typical printhead 10, having a lower base or substrate 12 of silicon, an upper layer of thickfilm flow feature 14 etched upon the silicon layer 12, and a nozzle plate 16 adhered to the upper surface 18 of flow feature 14 via a typical adhesive 20, of the type, for example, disclosed in U.S. Pat. No. 6,540,334. In the prior art, the thickfilm layer 14 is a polymeric photoresist material of a polyfunctional epoxy material such as the type found in U.S. Pat. No. 5,907,333, the disclosure of which is incorporated herein by reference. The nozzle plate 16 is typically made of metals or plastics, such as a polyimide polymer containing an adhesive layer which is laser ablated to provide the flow features. The adhesive layer 20 used to attach the nozzle plate 16 to the thickfilm layer 14 comprises a B-stageable material, as outlined in the '334 patent, such as a phenolic butyral adhesive. Such a layer of adhesive 20 results in an increase in the overall height of the nozzle plate 16 stackup, which restricts high firing frequencies. There is also illustrated in FIG. 3 a typical heater 22, positioned on the lower substrate or silicon chip 12, within a nozzle hole 24 formed in the nozzle plate 16 and thickfilm layer 14, which carries out the function as is well known in the prior art, disclosed for example in U.S. Pat. No. 4,609,316, the disclosure of which is incorporated herein by reference.

Turning now to exemplary embodiments of the present invention, reference is made to FIGS. 1 and 2, which are partial views of a printhead 100 which comprises a silicon chip or substrate 102, the thickness of the chip 102 typically ranging from about 200 to about 800 microns (though the printhead 100 can include any known substrate of any thickness typically used in a printhead). There is next provided a thick film layer 104, which in one embodiment is of a thickness in the range of 0.5 to 40 microns (though the thickness can range from 0.5 to 40 microns, for example, and is preferably 2 to 20 microns, and is more preferably 2 to 15 microns).

The thick film layer 104 can be adhered to substrate 102 through a photolithography process or through a second embodiment of a TCB process. The thick film layer 104, in an exemplary embodiment, also provides an upper surface 106 to provide adhesion of a nozzle plate 108 to the thick film layer 104 of printhead 100. Nozzle plate 108 preferably has a thickness of about 12.5 to 50.4 microns, more preferably about 25.4 to 50.4 microns. As further illustrated in FIGS. 1 and 2, print head 100 includes a plurality of heaters or heater resistors 110, arranged in the pattern as seen in top view in FIG. 2, allowing the heated ink to be ejected through a nozzle hole 112, as is known in the art. In FIG. 2, the nozzle plate 108 has not yet been adhered to the upper surface 106 of thick film layer 104.

The thick film layer 104, in an exemplary embodiment, comprises a polyimide photoresist in order to achieve the thickfilm flow features. It has been found through testing, that HD4000 brand polyimide (commercially available from HD Microsystems) works well, although any suitable photodefinable polyimide should work. The polyimide photoresist 104 is preferably bonded directly to the nozzle plate material 108, which is preferably also constructed of a polyimide polymer material, without the need for a separate adhesive therebetween. Since the photoresist layer 104 and the nozzle plate 108 may, in an exemplary embodiment, both comprise polyimides, the polyimide photoresist 104 can be imaged with flow features while still in a partially-uncured state, i.e., polyamic acid, and subsequently bonded directly to the nozzle plate 108 using thermal compression. During the thermal compression stage, the nozzle plate 108 and the photoresist layer 104 are raised to an elevated temperature preferably in the range of 302–752 degrees F., at which temperature the polyamic acid of the photoresist 104 is imidized (cured), forming a sufficient bond between the photoresist layer 104 and the nozzle plate material 108 so as to eliminate the need for additional nozzle plate adhesives. This type of bonding between the photoresist layer 104 and nozzle plate 108 also decreases the overall height of the nozzle plate 108 stackup (the stackup height is a problem found in the prior art). Such reduction of the height of the nozzle plate 108 enables higher firing frequencies to be achieved because of, for example, a shorter bore height.

Polyimide photoresist 104 has excellent imagability, which allows good resolution and high aspect ratios to be obtained. The properties of the polyimide photoresist 104 are far superior to those of the epoxy photoresists found in the prior art, and the polyimide photoresist 104 has a very high Tg (~300° C.), while demonstrating physical properties of having a high modulus and high tensile strength without being brittle. With a very low CTE (coefficient of thermal expansion) of the polyimide photoresist 104, the stresses caused by the CTE mismatch become much lower while the adhesion between the photoresist 104 and the nozzle plate 108 remain high, since the polyimide photoresist 104 is formulated to bond directly to the chip 100 and nozzle plate 108. Furthermore, the polyimide photoresist 104 does not deform under current TCB (thermal compression bond) processes due to its superior mechanical properties. This can substantially eliminate the possibility of squish and other applied stress-related problems observed when imaging flow features into current photoresists.

The polyimide photoresist 104 used in an embodiment of the present invention has been shown to have excellent adhesion to various metals such as silicon (Si), silicon oxide ($SiO_2$), silicon nitride (SiN), aluminum (Al), aluminum oxide ($Al_2O_3$), copper (Cu), titanium (Ti), and nickel vanadium alloy (NiV). Since the polyimide photoresist material 104 possesses a high modulus and high tensile strength without being brittle, higher fracture energies are obtained relative to epoxy based photoresists. Also, as a result of the polyimide photoresist 104 not possessing brittle qualities, and the CTE being very low, cracking of the photoresist 104 at the interface with the nozzle plate has not been observed. Furthermore, the polyimide photoresist 104 is very durable in the presence of various solvents and has exhibited excellent chemical compatibility with inks of the type produced by Lexmark. For example, the polyimide photoresist 104 has shown less than 1 to 10% mass uptake in the presence of inks of the type produced by Lexmark. Long-term adhesion testing in the presence of such inks has indicated that the polyimide photoresist 104 maintains excellent adhesion as a function of time and temperature.

Furthermore, one of the major advantages of the polyimide photoresist 104 can be that it utilizes an acrylate UV initiator, rather than a cationic initiator (such as Cyracure). A cationic initiator such as Cyracure produces as a by-product hydrofluoric acid (HF), a very strong acid which has been linked to flocculation of inks of the type produced by Lexmark. By utilizing an acrylate UV initiator, the potential for HF to interact with the ink and cause flocculation is eliminated. This can also eliminate the need for long post-bake cures that are currently used to remove HF out of the photoresist, which can reduce cycle time and reduce cost.

As seen in FIG. 1, the polyimide photoresist 104 is bonded directly to the nozzle plate 108 without an adhesive layer therebetween (such as layer 20 as illustrated in the prior art in FIG. 3). By using polyimide photoresist as a nozzle plate adhesive, as well as the imaging media for the flow features at a thickness of between 0.5 to 40 microns, a thinner nozzle plate stackup can be obtained, enabling higher firing frequencies. Therefore, a polyimide photoresist for thickfilm flow features can have significant advantages over current prior art, including good resolution, superior adhesion, no HF production, superior mechanical properties, high Tg, low CTE mismatch, excellent ink compatibility and the ability to bond directly to various nozzle plate materials.

Figure 4:
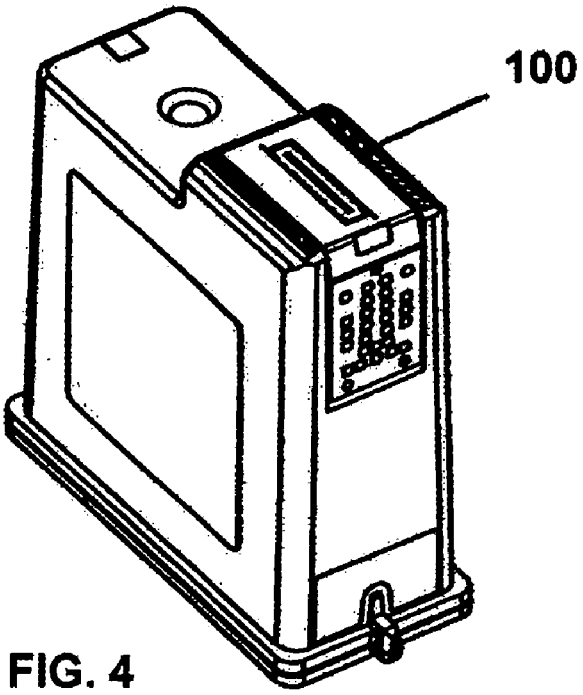
FIG. 4 shows an exemplary embodiment of an inkjet print head of the present invention.
Figure 5:
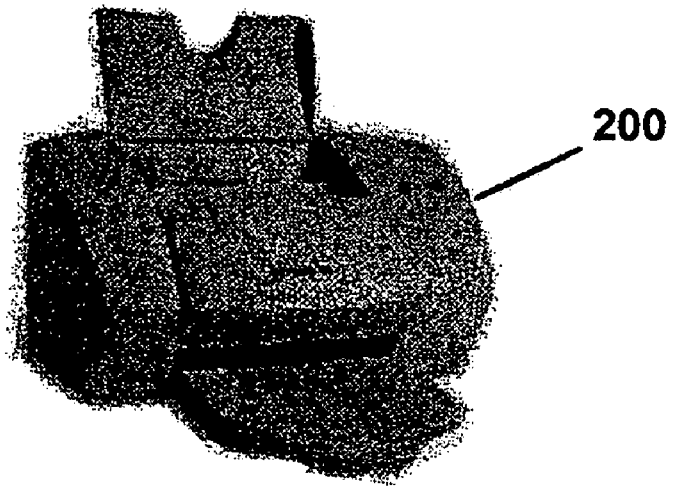
FIG. 5 shows an exemplary embodiment of the inkjet printer of the present invention including an inkjet print head.

FIG. 4 is a perspective view of printhead 100. Printhead 100 can be used, for example, in inkjet printer 200 (see FIG. 5). Inkjet printer 200 could be, for example, a Lexmark® Model Z51, Lexmark® Model Z31, and Lexmark® Model Z11, Lexmark® Photo Jetprinter 5770, or Kodak® PPM200 brand inkjet printer.

Another embodiment of the present invention involves a process to improve adhesion to polyimides. For example, it could involve a method for establishing optimal adhesion to a nozzle plate adhesive, TAB (tape automated bond) circuit, and cover coat, for example. Accordingly, this exemplary embodiment applies to several different areas for inkjet printheads including, for example, nozzle attach adhesives, encapsulant for top side encapsulate and TAB circuit cover coats.

The present inventors have determined a mechanism by the use of a catalyst to establish optimal adhesion to various polyimides. The ink jet industry has struggled in the past to obtain good adhesion and ink compatibility to the various polyimide surfaces that are bonded to in ink jet printheads.

Adhering to polyimide has proven itself to be a difficult task in the adhesion community. Not only do polyimides have low surface energies, they also are known to have very little topography. With this in mind, it has been difficult to find adhesives that will provide sufficient adhesion to polyimide nozzle plates. The present inventors have found a catalyst for epoxy/phenolic adhesives that appears to eliminate the difficulties in adhering to polyimides and are compatible with printer ink.

By using an epoxy-based adhesive or an epoxy/phenolic hybrid adhesive with a specific alkaline (basic) catalyst, adhesion to polyimides may be obtained. The mechanism for this process is the ability of the basic catalyst to open the imide ring on the surface of the polyimide under specific conditions. In order for this mechanism to occur, the activation energy of the catalyst must be high enough to open the imide ring. Once the imide ring is open, the adhesive can react into the polyimide by either forming an amide linkage or imidizing the amide by ring closing. Using dicyandiamide as a catalyst, the mechanism described above was obtained and adhesion to the polyimide (Upilex S, Kapton E, Kapton H, Kapton VN, polyether imides) was generated. The adhesion of the catalyst/epoxy/phenolic system showed significant improvement in adhesion and compatibility with ink jet printer ink compared to other general one-part epoxy adhesives, two-part epoxy adhesives, acrylic adhesives, phenolic adhesives, and bismalimide adhesives.

By utilizing this catalyst in this mechanism, one can obtain substantial improvement in adhesion, corrosion resistance, and ink compatibility for the nozzle plate adhesive, topside encapsulant, and TAB circuit cover coat, for example. Another benefit for implementing this catalyst/adhesive system can be that the time to cure is dramatically decreased, which will help reduce production time and throughput for manufacturing.

The catalyst can be formulated into various adhesive formations specifically for adhering to polyimide surfaces. The catalyst also could be used as an adhesion promoter for epoxy/polyimide joints. By applying this molecule on the surface and reacting into the polyimide, the free amide from the dicyandiamide then can react into the adhering epoxy.

The present embodiment of the invention can be illustrated by reference to FIG. 3, where if nozzle plate 16 is made of polyimide, and adhesive layer 20 is made of epoxy, the catalyst, which is preferably dicyandiamide, but can alternatively comprise dicyandiamide derivatives, such as dicyanoanthracene, dicyanobenzene, or 1,4 dicyano-2-butene, for example, is applied to a surface of nozzle plate 16 which will contact epoxy layer 20, then nozzle plate 16 is applied to epoxy layer 20. The catalyst causes the polyimide layer 16 to bond chemically to epoxy layer 20. In other embodiments, printhead 100 can include a polyimide bonded to other materials with the assistance of the aforementioned catalyst.

PARTS LIST

The following is a list of parts and materials discussed with respect to embodiments of the present invention:

100 printhead
102 silicon chip or substrate
104 thick film layer (polyimide photoresist)
106 upper surface of layer 104
108 nozzle plate
110 heaters or heater resistors
112 nozzle hole
200 inkjet printer

PRIOR ART PARTS LIST

10 printhead
12 silicon chip
14 thick film layer of polyfunctional epoxy material
16 nozzle plate
18 upper surface of layer 14
20 adhesive layer
22 heaters or heater resistors
24 nozzle hole All measurements disclosed herein are at standard temperature and pressure, at sea level on Earth, unless indicated otherwise.

The foregoing embodiments are presented by way of example only; the scope of the present invention is to be limited only by the following claims.

What is claimed is:

1. An inkjet printhead, which comprises:

a. a substrate material having an upper surface;

b. a thick film photoresist layer of a polyimide polymer deposited on the upper surface of the substrate material, the thick film photoresist layer having an upper surface;

c. a polyimide polymer nozzle plate material bonded directly to the upper surface of the polyimide polymer photoresist layer without the presence of an adhesive, wherein the polyimide photoresist comprises an acrylate UV inititator to provide adhesion properties to allow bonding directly to the nozzle plate material.

2. The printhead in claim 1, wherein the polyimide polymer of the polyimide photoresist includes a polyamic acid state, and the polyimide photoresist is bonded to the nozzle plate material while the polyimide polymer is in the polyamic acid state.

3. The printhead in claim 1, wherein the polyimide photoresist is bonded to the nozzle plate through thermal compression at a temperature of about 302 to 752 degrees Fahrenheit.

4. The printhead in claim 1, wherein the polyimide photoresist layer is about 0.5 to 40 microns thick.

5. An inkjet printer including an inkjet printhead, the inkjet printhead comprising:

a. a substrate material;

b. a thick film photoresist layer of a polyimide polymer deposited on an upper surface of the substrate material; and c. a polyimide polymer nozzle plate material bonded directly to an upper surface of the polyimide polymer photoresist layer without the presence of an adhesive, wherein the polyimide photoresist comprises an acrylate UV initiator to provide adhesion properties to allow bonding directly to the nozzle plate material.

6. The inikjet printer in claim 5, wherein the polyimide polymer of the polyimide photoresist includes a polyamic acid state, and the polyimide photoresist is bonded to the nozzle plate material while the polyimide polymer is in the polyamic acid state.

7. The inikjet printer in claim 5, wherein the polyimide photoresist is bonded to the nozzle plate through thermal compression at a temperature of about 302 to 752 degrees Fahrenheit.

8. The inkjet printer in claim 5, wherein the polyimide photoresist layer is about 0.5 to 40 microns thick.

* * * * *